United States Patent [19]

Warner

[11] Patent Number: 4,462,557

[45] Date of Patent: Jul. 31, 1984

[54] SPRING BIASED ELECTROMAGNETICALLY CONTROLLED TENSION CONTROL

[75] Inventor: Charles E. Warner, Spartanburg, S.C.

[73] Assignee: Milliken Research Corporation, Spartanburg, S.C.

[21] Appl. No.: 434,900

[22] Filed: Oct. 18, 1982

[51] Int. Cl.[3] ..... B65H 59/16; B65H 59/18; D01H 13/10

[52] U.S. Cl. ..... 242/150 M; 57/352; 242/147 R; 242/147 M

[58] Field of Search ..... 57/58.59, 58.7, 58.72, 57/58.83, 58.86, 90–94, 100, 127.5, 127.7, 206, 208, 264, 282, 283, 284, 351, 352, 354; 242/131, 131.1, 150 M, 147 R, 147 M, 149, 150 R, 156.2

[56] References Cited

U.S. PATENT DOCUMENTS

| | | | |
|---|---|---|---|
| 2,624,527 | 1/1953 | Von Kohorn | 242/155 |
| 2,705,362 | 4/1955 | Roughsedge | 28/51 |
| 2,724,065 | 11/1955 | Saxl | 310/93 |
| 2,931,090 | 4/1960 | Field, Jr. | 28/1 |
| 2,946,177 | 7/1960 | Scragg et al. | 57/284 |
| 2,978,203 | 4/1961 | Westall et al. | 242/155 |
| 2,999,351 | 9/1961 | Davenport et al. | 57/140 |
| 3,011,736 | 12/1961 | Furst et al. | 57/352 X |
| 3,016,681 | 1/1962 | Andremont | 57/354 X |
| 3,022,025 | 2/1962 | Saxl | 242/155 |
| 3,047,932 | 8/1962 | Pittman et al. | 28/1 |
| 3,053,474 | 9/1962 | Luntz et al. | 242/150 M |
| 3,095,630 | 7/1963 | Pittman | 28/1 |
| 3,100,091 | 8/1963 | Mindheim et al. | 242/150 M |
| 3,106,442 | 10/1963 | Compostella et al. | 18/48 |
| 3,112,600 | 12/1963 | Stoddard et al. | 57/34 |
| 3,113,746 | 12/1963 | Steen | 242/155 |
| 3,152,436 | 10/1964 | Dudzik et al. | 57/157 |
| 3,194,000 | 7/1965 | Eldridge et al. | 57/34 |
| 3,352,511 | 11/1967 | Wiggins | 242/155 |
| 3,438,194 | 4/1969 | Cerutti et al. | 57/157 |
| 3,457,715 | 7/1969 | Eldridge et al. | 57/6 |
| 3,606,196 | 9/1971 | Heard | 242/155 M |
| 3,724,409 | 4/1973 | Olney, Jr. | 112/255 |
| 3,782,091 | 1/1974 | Spurgeon | 57/34 HS |
| 3,797,775 | 3/1974 | White | 242/155 M |
| 3,831,880 | 8/1974 | White et al. | 242/156 |
| 3,897,916 | 8/1975 | Rosen | 242/155 M |
| 4,035,879 | 7/1977 | Schippers | 28/246 |
| 4,112,561 | 9/1978 | Norris et al. | 57/91 X |
| 4,186,896 | 2/1980 | Brandenberger et al. | 242/131 |
| 4,313,578 | 2/1982 | Wilson et al. | 242/150 M |

*Primary Examiner*—Donald Watkins

*Attorney, Agent, or Firm*—Earle R. Marden; H. William Petry

[57] ABSTRACT

An electromagnetic disc type tension control in which a spring-like member is located between the electromagnetic coil and the lower tension disc to urge the lower tension disc upward towards the upper tension disc when the electromagnet is being supplied low voltage in order to encourage rotation of the tension discs to enhance the removal of finish and foreign material accumulated therebetween.

2 Claims, 8 Drawing Figures

SPRING BIASED ELECTROMAGNETICALLY CONTROLLED TENSION CONTROL

This invention relates generally to the employment of an electromagnetically actuated disc tension control to intermittently grasp and release a continuous filament synthetic yarn which is being processed downstream of the tension control.

It is an object of the invention to provide a yarn processing system which employs a disc tension control to randomly vary the tension of a yarn being processed in a yarn processing machine.

Other objects and advantages of the invention will become readily apparent as the specification proceeds to describe the invention with reference to the accompanying drawings, in which.

Figure 1:
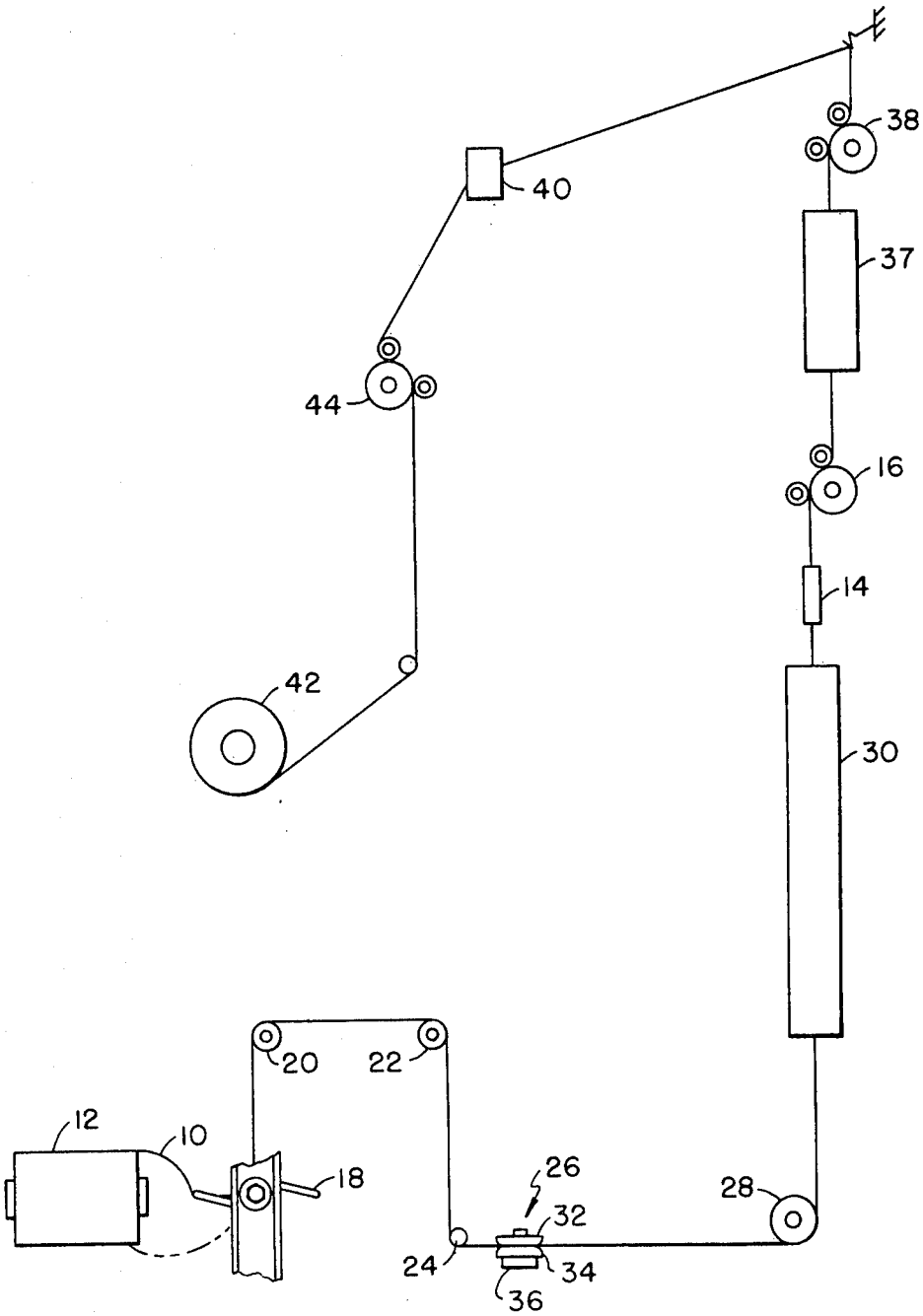
FIG. 1 is an overall schematic representation of the new and novel system to produce a textured, continuous filament synthetic yarn.

Looking now to FIG. 1, the overall system of FIG. 1 will be explained to obtain the novel disclosed yarn. The system is directed to a method to produce a specially textured yarn by intermittently varying the draw of a continuous filament, partially oriented synthetic, multifilament yarn such as polyester. The multifilament yarn 10 is supplied from a supply package 12 to the false twist device 14 by the feed roll device 16. The yarn 10 from the package 12 successively, in its travel to the feed roll device 16, passes through the balloon control apparatus 18, over the guide members 20, 22 and 24 through the electro-magnetically controlled tension disc apparatus 26 and under the guide member 28 through the primary heater 30 and false twist device 14 to the feed roll device 16. The yarn 10 is intermittently and randomly drawn in the primary heater 30 by the intermittent hold back action of the disc tension apparatus 26. The discs 32 and 34 are intermittently and randomly drawn together and released on the yarn 10 by the action of the electromagnet 36 controlled by the varying voltage supplied thereto by a suitable voltage source which is varied by the action of a random signal generator.

From the feed roll device 16 the textured yarn passes through the secondary heater 37 with very little overfeed since the speed of the feed roll device 38 is substantially the same as the feed roll device 16 and the crimp in the yarn is allowed to set. Depending on the amount of crimp contraction desired the secondary heater can be turned on at an appropriate temperature or off or by-passed and the overfeed varied from high to very little.

The feed roll device 38 is driven at a higher speed than the feed roll device 44 to overfeed the textured yarn through the air jet entangling device 40 to commingle and entangle the individual filaments of the textured yarn. From the feed roll device 38 the entangled, textured yarn is slightly overfed to the yarn take-up package 42 by the feed roll device 44.

Figure 2:
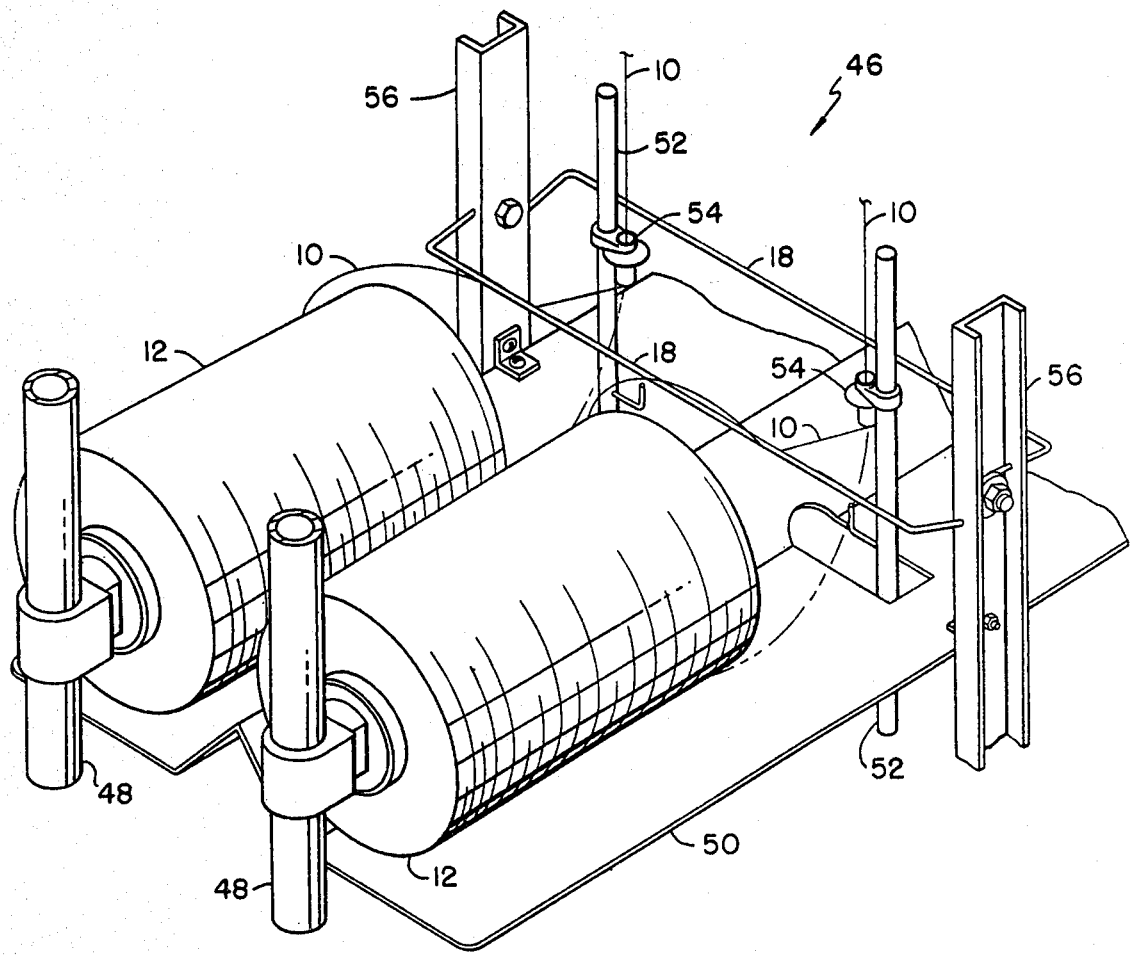
FIG. 2 is a partial perspective view of the yarn supply creel for the system shown in FIG. 1.

Schematically in FIG. 1, the yarn package 12 and the balloon control element 18 are shown as separate items but in actual practice a creel unit, designated 46 in FIG. 2, is used. The creel unit 46 supports a plurality of packages 12 for a plurality of false twist spindle positions and is slid in and out of position relative to a multiple spindle false twisting machine. In FIG. 2 a partial creel is shown supporting a pair of supply packages held on creel pins supported by creel pin support members 48 that are connected to the creel. Also connected to the creel is a horizontal separation plate 50 through which the yarn guide supports 52 project. A yarn guide 54 for each yarn package is connected thereto to guide the yarn 10 from the package 12 towards the guide member 20. Mounted on both sides of the horizontal separator plate 50 is a channel beam 56 between which is connected the balloon control apparatus or bar 18. The balloon of yarn from the creel is unusually erratic and violent due to the alternating take-off velocity and is therefore prone to entanglement if not controlled. As shown in FIG. 2 the bar 18 prevents yarn 10 from the package 12 from forming a full balloon and getting entangled in and around various elements of the creel such as yarn guides 54. As shown in FIG. 2, a second bar 18 is shown which is used for the same purpose for the yarn packages (not shown) on the opposite side of the creel unit 46.

Figure 3:
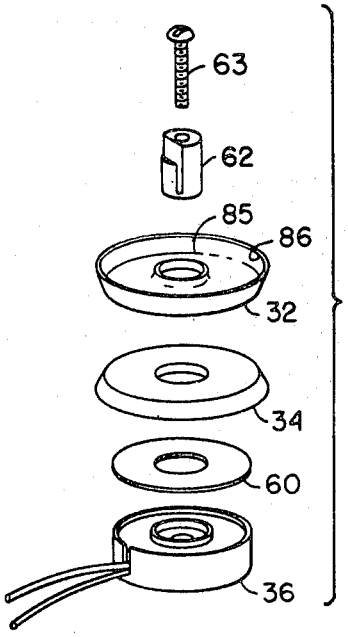
FIG. 3 is an exploded schematic view of the yarn tension disc device used in the system of FIG. 1.
Figure 4:
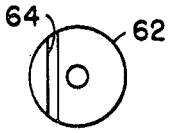
FIG. 4 is a top view of the post of the yarn tension disc device of FIG. 3.
Figure 5:
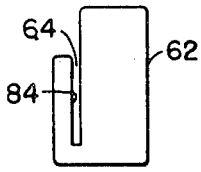
FIG. 5 is a side elevation view of the post shown in FIG. 4.
Figure 6:
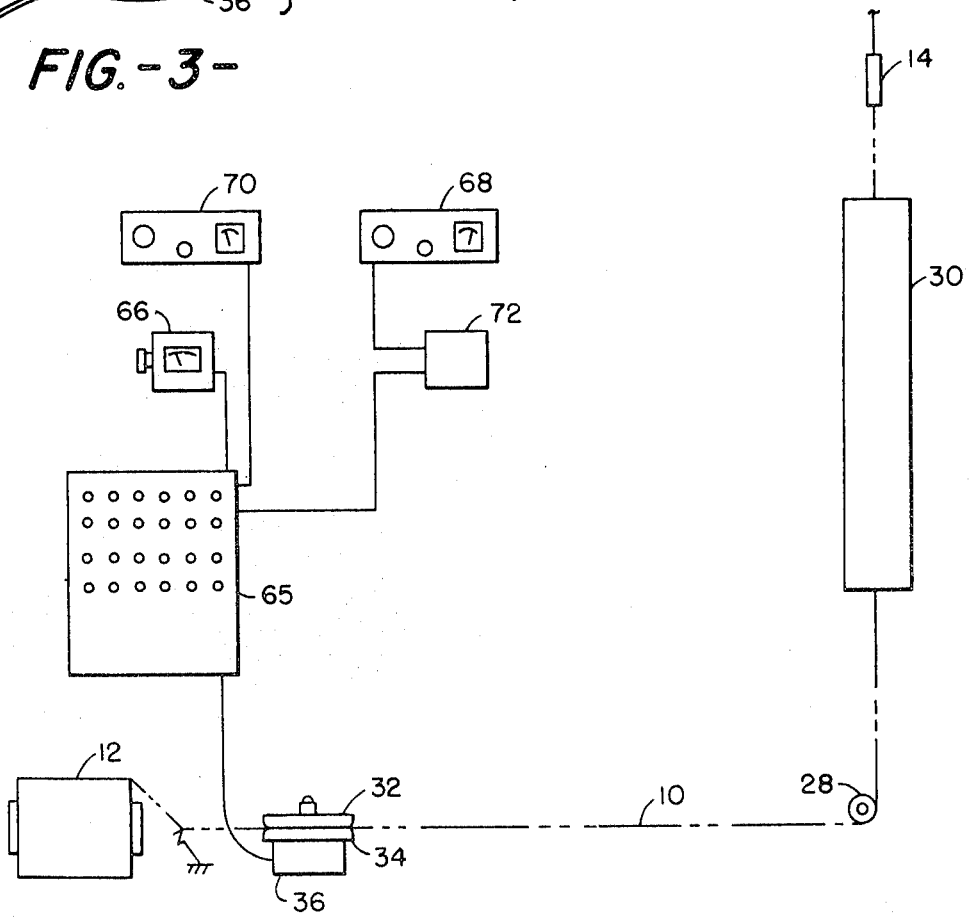
FIG. 6 is a schematic representation of the voltage control scheme for the yarn tension disc electromagnet.
Figure 7:
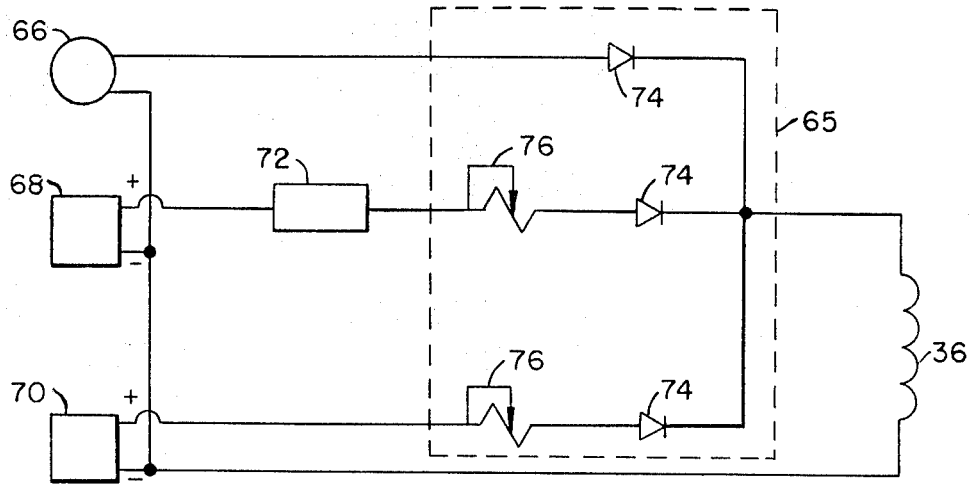
FIG. 7 is a circuit diagram for the electromagnet of the yarn tension disc device.

FIGS. 3–5 show the electromagnetically controlled tension disc apparatus 26 in detail. The apparatus 26 basically consists of the electromagnet 36, the spring biasing member 60 of Teflon® or other suitable material, the tension discs 32 and 34, the disc post 62 and the screw 63 to maintain the aforementioned element in operative relationship. The disc 32 is made from a magnetically attractable material such as a ferrous material while the disc 34 is manufactured from a non-magnetically attractable material. For reasons hereafter explained the post 62 has a slot 64 therein which is off set from the centerline of the post. Also for reasons hereinafter explained, it is desired to supply random, intermittent pulses of low and high D.C. voltage with a superimposed A.C. voltage to cause the discs 32 and 34 to close randomly and intermittently and to cause the discs to vibrate relative to another and relative to the electromagnet 36. To accomplish this action the arrangement shown in FIG. 6 and the circuit shown in FIG. 7 are employed. Basically, the voltage to the electromagnet 36 is supplied from a in control box 65 which receives voltage from an A.C. power supply 66, a high voltage D.C. power supply 68 and a low voltage D.C. power supply 70. Connected between the high voltage D.C. source 68 and the control box 65 is a random signal generator 72 of the type disclosed in U.S. Pat. No. 4,160,359 which intermittently and randomly interrupts the voltage from the high voltage D.C. source to the control box 65. Located in each circuit to the electromagnet 36 is a diode 74 which only allows current to flow in one direction towards the electromagnet 36. Schematically represented in the high and low voltage D.C. circuit is an adjust switch or variable resistor 76 to adjust the D.C. voltage in the respective circuit.

Figure 8:
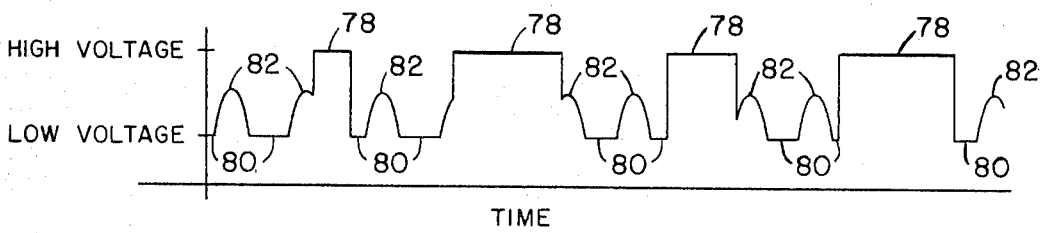
FIG. 8 is a graphical representation of the voltage supplied to the electromagnet of the yarn tension disc device.

As represented in the graph of FIG. 8, the A.C. voltage from the source 66 supplies A.C. voltage continuously while the high D.C. voltage from the source 68 is interrupted randomly and continuously by the random signal generator 72. As indicated in the graph, this provides periods of high voltage 78 and low voltage 80 for different durations of time, as well as peaks 82 at times when the high voltage D.C. current is not being supplied and the A.C. voltage is at its positive peak on its cycle. The various lengths of the high voltage peak 78 represent periods when the yarn 10 is being held tightly between the discs 32 and 34 while the peaks 82 and the low voltage periods 80 represent periods when the voltage is low and the discs 32 and 34 tend to release the grip on the yarn 10 and vibrate as the yarn passes therethrough. At these times the spring biasing member 60 causes the discs to be urged upward and allows the frictional resistance between the discs 32 and 34 and between the disc 34 and the electromagnet 36 to be reduced so that the torque exerted on the yarn passing through the slot 64 of the post 62 will cause them to rotate more efficiently to provide the self-cleaning action. The vibration of the discs allows the discs to be rotated more easily so that the yarn passing through will subsequently clean out the finish deposited between the discs by the yarn.

Alternatively, the wall 84 defining one portion of the slot 64 can be eliminated and replaced by an upstanding guide member, not shown, which will serve to confine the yarn path to a path offset from the centerline of the post 62.

In the preferred form of the invention the spring biasing member 60 is of a diameter greater than the inner, internal diameter 85 and less than the inner, external diameter 86 of the lower tension disc 34 so that it is curved downward at its extremities when the discs 32 and 34 are pulled towards the electromagnet 36. Conversely, when the voltage to the electromagnet is reduced, the upward force exerted due to the bias of the member urges the discs upward.

As described briefly before, it is desired to cause the tension discs 32 and 34 to rotate in order to dissipate the finish deposited therebetween by the yarn 10. As described above, the discs 32 and 34 are free to rotate on the post 62. To further enhance this rotation, the slot 64 is located off center of the centerline of the post so that the yarn passing between the discs 32 and 34 will exert a torque thereon. Furthermore, since the yarn 10 is located in the slot 64 between the discs 32 and 34, the yarn cannot jump out from between the discs and have to be rethreaded. Further, such location of the yarn in the slot prevents uncontrolled texturing and lessens the tendency for yarn breaks.

In the form described hereinabove the preparation of a single end of multifilament synthetic yarn is described but, depending on the ultimate use of the yarn produced, a plurality of yarns can be interlaced or commingled in the air jet 40. Examples of such yarn are set forth below.

EXAMPLE 1

Two ends of a 240 denier, 68 filament DuPont 56T polyester yarn were processed as described above and entangled or interlaced in the air jet 40 to provide a 2/150/68 yarn with an actual denier of 355. The elongation was 51% with a crimp contraction of 1%. The operating conditions were as follows:

False Twist Spindle Speed—96000 RPM
Yarn Speed through Spindle—117 yards/minute
False Twist—23 turns/inch
Twist Multiple—306
Direction—"S"
Yarn Overfeed Through Heater 37—By-passed
Yarn Overfeed Through Air Jet—4.0%
Yarn Overfeed to Take-Up—1.7%
Temperature of Heater 30—180° C.
Temperature of Heater 37—Off
High Pre-Spindle Tension Average—50 grams
Low Pre-Spindle Tension Average—12 grams The yarn thus produced has a very low crimp contraction with high luster and intermittent character.

EXAMPLE 2

Two ends of a 220 denier, 54 filament DuPont 693T polyester yarn were processed and entangled in the air jet 40 to provide a 2/150/54 yarn with an actual denier of 328. The elongation was 48% with a crimp contraction of 1.8%. The operating conditions were as follows:

False Twist Spindle Speed—129000 RPM
Yarn Speed through Spindle—127 yards/minute
False Twist—28 turns/inch
Twist Multiple—359
Direction—"S"
Yarn Overfeed through Heater 37—0
Yarn Overfeed through Air Jet—4.0%
Yarn Overfeed to Take-up—1.7%
Temperature of Heater 30—180° C.
Temperature of Heater 37—190° C.
High Pre-Spindle Tension Average—50 grams
Low Pre-Spindle Tension Average—16 grams The yarn produced has a low crimp contraction with very high luster and intermittent character.

It can readily be seen that the described apparatus and method provides a randomly, intermittently textured, continuous multifilament synthetic yarn which along its length has variable molecular orientation, bulk, torque, twist and shrinkage. The produced yarn has a low crimp contraction and a high luster. This yarn is especially useful in the fabrication of a velvet-type upholstery fabric and provides unique visual effects due to its variable dye affinity.

Although the preferred embodiment of the invention has been described, it is contemplated that many changes may be made without departing from the scope or spirit of the invention and it is desired that the invention be only limited by the scope of the claims.

I claim:

1. A magnetically controlled tension apparatus for a running length of yarn comprising: an electromagnet, a post member mounted on said electromagnet and projecting upwardly therefrom, a first dish shaped member freely mounted over said post, a second dish shaped member freely mounted over said post in contiguous relationship with said first dish shaped member, each of said dish shaped members having a flange portion on the outer extremity of the dish shaped member, said first dish shaped member having its flange projecting upwardly, said second dish shaped member having its flange projecting downwardly towards said electromagnet, said electromagnet exerting a downward force on said dish shaped members when a voltage is applied thereto and a spring biasing means on said post between said electromagnet and said dish shaped members to exert an upward force on said dish shaped members in opposition to the downward force of said electromagnet.

2. The tension apparatus of claim 1 wherein each of said flange portions flare outwardly from the respective dish shaped members, said spring biasing means having a diameter less than the outer internal diameter of said second dish shaped member whereby said spring biasing means is curved downward by said second dish shaped member when voltage is applied to said electromagnet.

* * * * *